United States Patent [19]

Weekley

[11] Patent Number: 4,971,232

[45] Date of Patent: Nov. 20, 1990

[54] NOZZLE SHROUD FOR A MOLTEN METAL STREAM

[75] Inventor: David L. Weekley, Newton Falls, Ohio

[73] Assignee: Vac Tec, Inc., Salem, Ohio

[21] Appl. No.: 502,699

[22] Filed: Apr. 2, 1990

[51] Int. Cl.[5] ..... B22D 37/00

[52] U.S. Cl. ..... 222/603; 222/607

[58] Field of Search ..... 222/603, 606, 607, ; 266/236, 287; 164/337

[56] References Cited

U.S. PATENT DOCUMENTS 3,460,725 8/1969 Golde et al. ..... 222/603

4,730,812 3/1988 Mielke ..... 266/236

*Primary Examiner*—S. Kastler

*Attorney, Agent, or Firm*—Harpman & Harpman

[57] ABSTRACT

A nozzle shroud for shielding the pouring of molten metal into a gas filled neutral atmosphere from a metallurgical vessel to a central trumpet associated with ingot molds and the like. The shroud is a vacuum formed fiber structure positioned in sealing relation with the metallurgical vessel nozzle by support the gas injection assembly providing a sealing relationship between the nozzle and pouring receiving receptacle.

7 Claims, 2 Drawing Sheets

NOZZLE SHROUD FOR A MOLTEN METAL STREAM

BACKGROUND OF THE INVENTION

1. Technical Field

This invention relates to shroud devices that are used to maintain neutral atmosphere around a molten metal stream to prevent contamination from outside atmosphere required in high quality metal production.

2. Description of Prior Art

Prior Art devices of this type have used a variety of different shrouding configurations to shield and isolate molten metal streams in a neutral atmosphere during transfer from a ladle, see for example applicant's own U.S. Pat. Nos. 4,840,287 4,527,718, 4,555,050 and 4,316,561.

In U.S. Pat. No. 4,840,297 a shielding apparatus is disclosed that provides a seal between a metal wear assembly on the ladle and a runner trumpet.

In U.S. Pat. No. 4,527,718 a shielding device is disclosed with a support housing having a ceramic ring positioned therearound. Inert gas supplied to the support housing by an inlet pipe and a seal is achieved between the housing and the insert and the ladle respectively.

In U.S. Pat. No. 4,555,050 a closure device is shown with a gas seal. A conical discharge nozzle is inserted into a shielding tube having an interior registering conical surface. Inert gas is delivered via an annular recess within the shielding tube to form a gas and mechanical seal therebetween.

U.S. Pat. No. 4,316,561 is directed to a latching apparatus to support and position a pouring tube shroud from a metallurgical vessel. The device has an elongated arm configuration with a tube engaging fitting and release mechanism allowing the support and placement of the tube shroud during pouring.

SUMMARY OF THE INVENTION

A nozzle shroud for shielding the pouring of molten metal in a neutral atmosphere between a metallurgical vessel and a receiving vessel by forming a positive seal therebetween. Inert gas is injected through a shroud support and placement holder removably engageable on the shroud. The shroud is formed of a monolithic ceramic fiber structure configured to receive the support and placement holder and to form a seal between the nozzle and the engagement surface of the receptacle receiving structure.

DESCRIPTION OF THE PREFERRED EMBODIMENT

Figure 1:
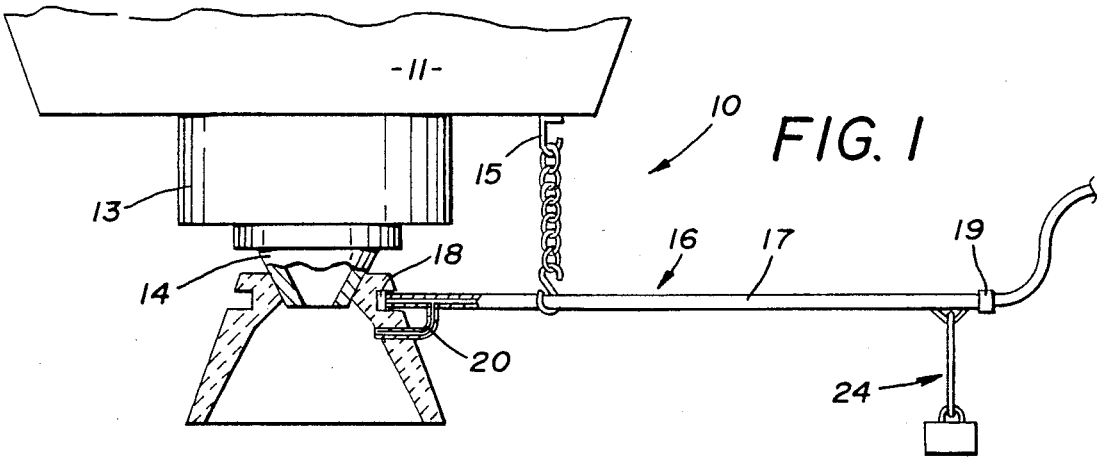
FIG. 1 is a partial cross-sectional view of a ladle and nozzle assembly with the ceramic shroud and support device positioned thereon.
Figure 2:
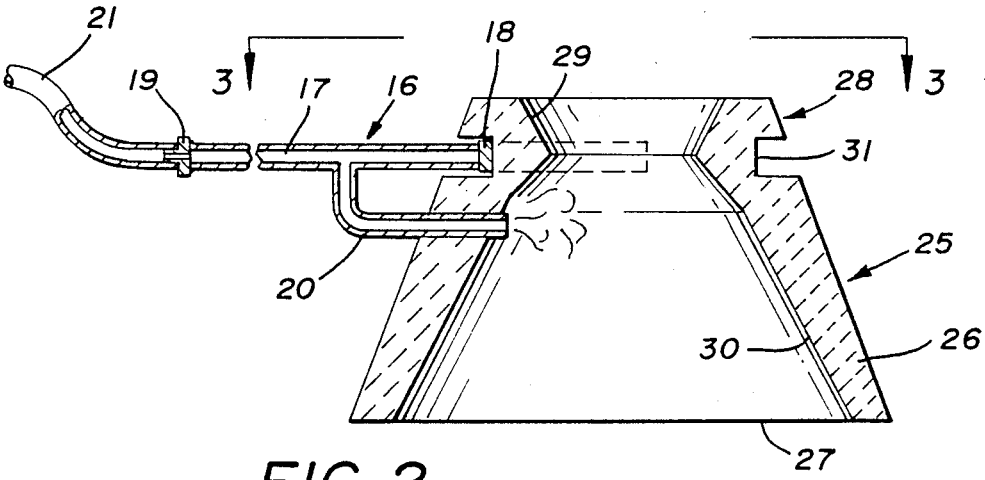
FIG. 2 is an enlarged cross-sectional view of the ceramic shroud and support supplying inert gas within the shroud.
Figure 3:
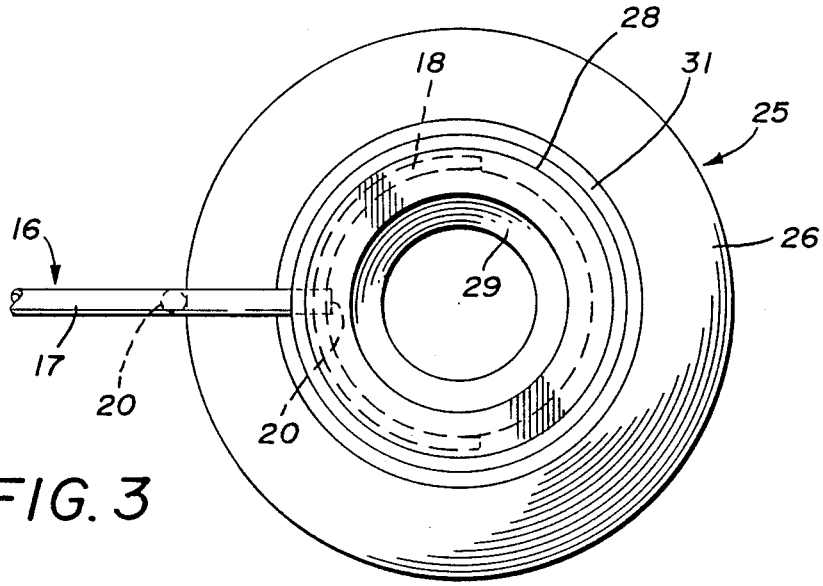
FIG. 3 is a view on lines 3—3 of FIG. 2.
Figure 4:
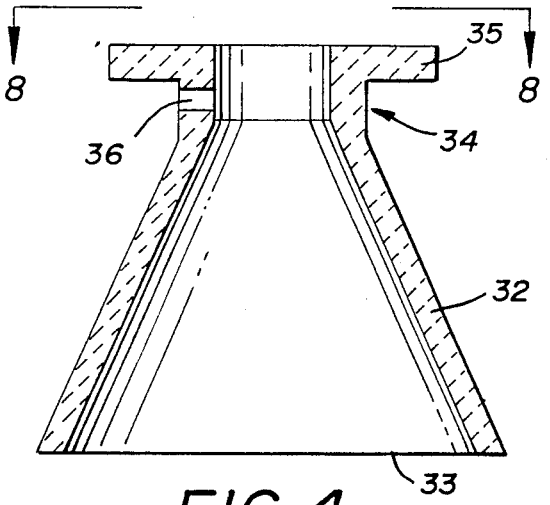
FIG. 4 is an enlarged cross-sectional view of an alternate form of the invention.
Figure 8:
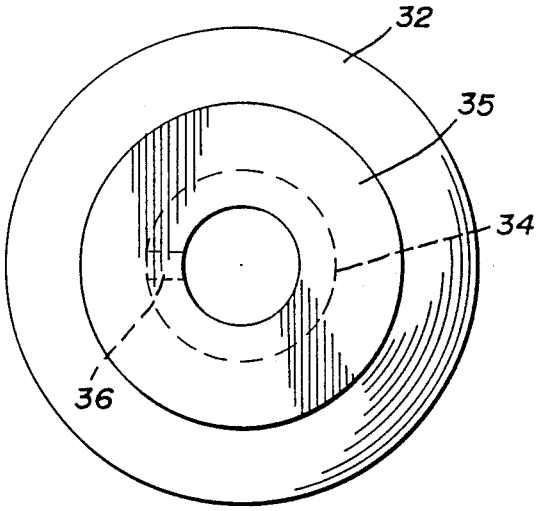
FIG. 8 is a top plan view on lines 8—8 of FIG. 4.
Figure 5:
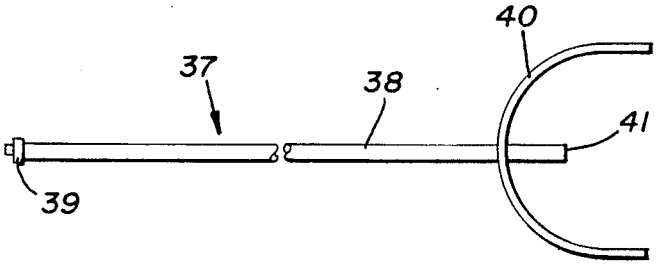
FIG. 5 is a top plan view of an alternate support for the alternate ceramic shroud.
Figure 6:
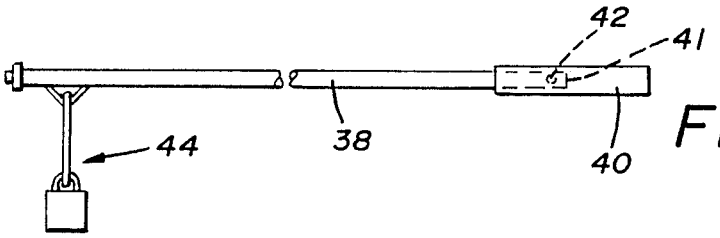
FIG. 6 is a side plan view of the alternate support of FIG. 5.
Figure 7:
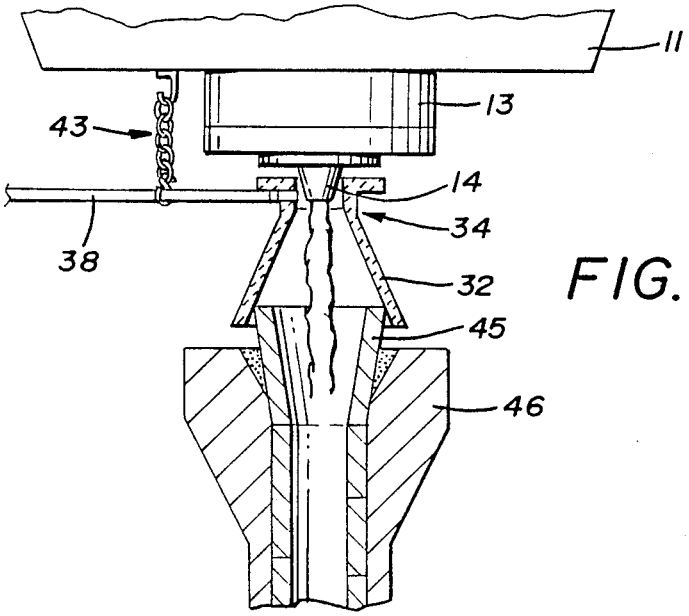
FIG. 7 is a partial cross-sectional view of a ladle and nozzle assembly and the alternate shroud and support device positioned in relation thereto.

Referring to FIGS. 1, 2, and 3 of the drawings, a shroud and support assembly 10 for shielding the pouring of molten metal in a neutral atmosphere can be seen. A portion of a metallurgical ladle 11 having a metal shell and a nozzle gate assembly 13 is shown in FIG. 1 from which extends a refractory nozzle 14. It will be apparent to those skilled in the art that a variety of molten metal control gates can be utilized associated with the metallurgical ladle 11.

A J hook 15 is secured to and extends from the metallurgical ladle 11 providing a point of pivotal attachment for a shroud holder 10. The shroud holder 16 is comprised of an elongated tubular member 17 which is bifurcated at one end and has a support bracket 18 extending therefrom and a gas receiving fitting 19 on the opposite free end thereof. A secondary tubular member 20 extends from and communicates in parallel vertical alignment with said elongated tubular member 17 inwardly from the support bracket 18.

The secondary tubular member 20 being vertically offset, as noted above, provides an outlet point for inert gas supplied to the elongated tubular member 17 via the fitting 19 by a gas supply line 21. A support chain 22 extends from the J hook 15 to a S fitting 23 slideably engaged on the elongated tubular member 17 adjacent its support bracket 18. A weight assembly 24 is suspended from said elongated tubular member 17 at its oppositely disposed end adjacent said fitting 19 that acts as a counter-balance as will be explained in greater detail later.

A nozzle shroud 25 can be seen in FIGS. 1, 2, and 3 of the drawings comprising a generally frusto conical contoured monolithic body member 20 defining an apertured base 27 and a nozzle engaging portion 28. The nozzle engagement portion 28 has an inclined inner conical surface 29 extending from the upper end of said nozzle engagement portion 28 to a point of intersection with an inner reverse angled conical wall descending surface 30 of the body member 26. An annular notch 31 is formed within the nozzle engagement portion 28 to accept and register with the hereinbefore described support bracket 18, best seen in FIGS. 2 and 3 of the drawings as having a half arcuate configuration extending from the end of the elongated tubular member 17.

The nozzle shroud 25 is composed of a ceramic fiber composition of a high purity alumina-silica ceramic fibers and organic and inorganic binders with a typical chemical analysis of 4.2% $Al_2O_3$, 52% $S_iO_2$, 1.3% trace inorganics and 4.5% LOI (organic binders).

The nozzle shroud is a vacuum formed monolithic shape and can be formulated to various compositions and densities dependent on the temperature requirements which are typically between 2,600° and 3,000° Farenheit.

Referring now to FIGS. 4–8 of the drawings, an alternate form of the invention can be seen wherein a secondary shroud device has a generally conical wall shaped body member 32 that extends from an open base portion 33 to an apertured nozzle engagement portion 34. The apertured nozzle engagement portion 34 has an annular engagement flange 35 extending outwardly therefrom. A horizontally disposed access bore 36 extends through the nozzle engagement portion 34 and receives in aligned registration a portion of an alternate configured shroud holder 37 seen in FIGS. 5,6, and 7 of the drawings.

The alternate shroud holder 37 comprising a tubular member 38 having a gas injection fitting 39 on one end thereof and a secondary support bracket 40 inwardly from the opposite free end thereof. The portion of said tubular member 88 extending beyond said intersection with said secondary support bracket 40 registers with and extends into said access bore 36 and has a closed end at 41 with a pair of oppositely disposed outlet ports 42 to supply inert gas to the interior of the shroud.

A secondary support chain assembly 4S and counter-weight assembly 44 are positioned and extend respectively from the elongated tubular member 38 and in conjunction with one another acts to pivotally hold the alternate shroud up against and in sealing relation with the nozzle 14 as hereinbefore described.

In operation, the shroud device is positioned up against the nozzle 14 and is moved with the nozzle 14 to align with funnel brick 45 of a center trumpet 46 in a bottom pour ingot configuration or alternately other pouring configurations such as top pouring or foundry pouring (not shown) both of which are well understood and known within the art.

It will be evident from the above referred to description that while the shroud can be selectively engaged against the nozzle 14 of the metallurgical vessel it will always move with the pouring facility and be positioned over or into the various applications of receiving vessels which are dependent upon configuration and environment as will be obvious to those skilled in the art Thus it will be seen that a new and useful device has been illustrated and described and it will be apparent to those skilled in the art that various changes and modifications may be made therein without departing from the spirit of the invention, therefore I claim:

1. A nozzle shroud and support apparatus for use in pouring molten metal from a metallurgical vessel having an outlet to a receptacle, maintaining a neutral atmosphere around a molten metal stream comprising in combination a nozzle shroud formed of a monolithic ceramic fiber composition body member having a frusto conical wall with an apertured base and an oppositely disposed nozzle engagement portion, said nozzle engagement portion including an inner conical wall surface angularly intersecting said frusto conical's inner wall surface, an annular notch in said nozzle engagement portion, and an aperture in said frusto conical wall adjacent said notch, a shroud support apparatus comprising an elongated tubular member having a bifurcated end and a shroud engagement bracket extending therefrom means for supplying inert gas through said elongated tubular member to said shroud, means for pivotally securing said elongated tubular member to said metallurgical vessel and means for removably securing said shroud to said metallurgical vessel.

2. The nozzle shroud and support apparatus of claim 1 wherein said means for supplying inert gas comprises a gas supply line and source of inert gas connected to said elongated tubular member.

3. The nozzle shroud and support apparatus of claim 1 wherein said means for pivotally securing said elongated tubular member to said metallurgical vessel comprises a hook and chain assembly.

4. The nozzle shroud and support apparatus of claim 1 wherein said means for removably securing said nozzle shroud to said metallurgical vessel comprises a counter-weight assembly on said free end of said elongated tubular member.

5. The shroud apparatus of claim 1 wherein said ceramic fiber composition is comprises of alumina-silica ceramic fibers, organic and nonorganic binders.

6. The shroud apparatus of claim 5 wherein said ceramic fiber composition of alumina-silica ceramic fibers, organic and nonorganic binders are combined in a typical formulation of 42.2% $Al_2O_3$, 52% $S_iO_2$, 1.3% trace inorganics and 4.5% LOI organic binder material.

7. A shroud and support apparatus for use in pouring molten metal from a metallurgical vessel to a receptacle while maintaining a neutral atmosphere comprises in combination a nozzle shroud conformed of a monolithic ceramic fiber composition body member having a conical wall with an apertured base and a apertured nozzle engagement portion, an annular support flange extending from said nozzle engagement portion, and an access bore in said conical wall adjacent said annular flange, said support assembly comprising an elongated tubular member, a secondary shroud support bracket extending from one end thereof, a hook and chain assembly pivotally securing said elongated tubular member from said metallurgical vessel, a counter-weight assembly engageable on said elongated tubular member and an inert gas supply communicating with said elongated tubular member for supplying inert gas to said shroud.

* * * * *